US006221411B1

(12) United States Patent
Sanfilippo et al.

(10) Patent No.: US 6,221,411 B1
(45) Date of Patent: Apr. 24, 2001

(54) MEAT PACKAGING APPARATUS AND METHOD

(75) Inventors: James J. Sanfilippo, Chicago; John E. Sanfilippo, Barrington; Bruce E. Edwards, Chicago, all of IL (US)

(73) Assignee: Jescorp, Inc., Des Plaines, IL (US)

( * ) Notice: Subject to any disclaimer, the term of this patent is extended or adjusted under 35 U.S.C. 154(b) by 0 days.

(21) Appl. No.: 09/152,001

(22) Filed: Sep. 11, 1998

(51) Int. Cl.[7] ..... I21D 10/02

(52) U.S. Cl. ..... 426/129; 426/118; 426/396; 426/415; 426/418; 426/432; 426/433; 426/444

(58) Field of Search ..... 426/129, 418, 426/396, 118, 415; 53/432, 433, 434

(56) References Cited

U.S. PATENT DOCUMENTS

| | | | | |
|---|---|---|---|---|
| 2,732,092 | | 1/1956 | Lawrence . | |
| 3,083,861 | | 4/1963 | Amberg et al. . | |
| 3,363,395 | | 1/1968 | King . | |
| 3,481,100 | | 12/1969 | Bergstrom . | |
| 3,545,163 | | 12/1970 | Mahaffy et al. . | |
| 3,574,642 | | 4/1971 | Weinke . | |
| 3,587,839 | | 6/1971 | Von Brecht . | |
| 3,615,691 | * | 10/1971 | Duiven | 426/265 |
| 3,634,993 | | 1/1972 | Pasco et al. . | |
| 4,143,165 | * | 3/1979 | Daswick | 426/113 |
| 4,340,138 | | 7/1982 | Bernhardt . | |
| 4,349,999 | | 9/1982 | Mahaffy et al. . | |
| 4,411,122 | | 10/1983 | Cornish et al. . | |
| 4,517,206 | | 5/1985 | Murphy et al. . | |
| 4,548,824 | * | 10/1985 | Mitchell et al. | 426/129 |
| 4,574,174 | | 3/1986 | McGonigle . | |
| 4,593,816 | | 6/1986 | Langenbeck . | |
| 4,622,229 | | 11/1986 | Toshitsugu . | |
| 4,661,326 | | 4/1987 | Schainholz . | |
| 4,685,274 | | 8/1987 | Garwood . | |
| 4,704,254 | | 11/1987 | Nichols . | |
| 4,728,504 | | 3/1988 | Nichols . | |
| 4,765,499 | | 8/1988 | Von Reis et al. . | |
| 4,783,321 | | 11/1988 | Spence . | |
| 4,840,271 | | 6/1989 | Garwood . | |
| 5,025,611 | | 6/1991 | Garwood . | |
| 5,101,611 | | 4/1992 | Biskup et al. . | |
| 5,103,618 | | 4/1992 | Garwood . | |
| 5,115,624 | | 5/1992 | Garwood . | |
| 5,129,512 | | 7/1992 | Garwood . | |
| 5,155,974 | | 10/1992 | Garwood . | |
| 5,226,531 | | 7/1993 | Garwood . | |
| 5,323,590 | | 6/1994 | Garwood . | |
| 5,334,405 | | 8/1994 | Gorlich . | |
| 5,348,752 | | 9/1994 | Gorlich . | |
| 5,384,103 | | 1/1995 | Miller . | |
| 5,409,126 | | 4/1995 | Demars . | |
| 5,667,827 | | 9/1997 | Breen et al. . | |
| 5,686,126 | * | 11/1997 | Noel et al. | 426/127 |
| 5,711,978 | | 1/1998 | Breen et al. . | |
| 5,730,311 | | 3/1998 | Curtis . | |

OTHER PUBLICATIONS

Brochure entitled "It's rare to witness two revolutions in a lifetime.", (Cryovac Division, W.R. Grace & Co. 1997, 12 pp.

* cited by examiner

*Primary Examiner*—Gabrielle Brouillette
*Assistant Examiner*—Hao Mai
(74) *Attorney, Agent, or Firm*—Baniak Nicholas Pine & Gannon

(57) ABSTRACT

A meat packaging apparatus includes a tray containing a modified atmosphere and meat product, a film sealed to the tray and including an opening, and a two-piece label attached to the film and covering the opening. The two-piece label including a first layer removably attached to a second layer, which is attached to the film. The second layer is made of a highly oxygen permeable material to allow oxygen to enter the tray when the top layer is removed.

18 Claims, 2 Drawing Sheets

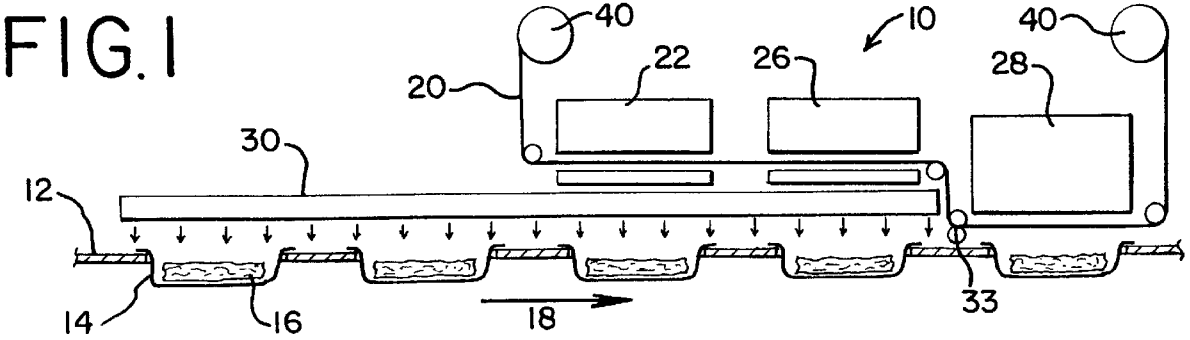
FIG. 1
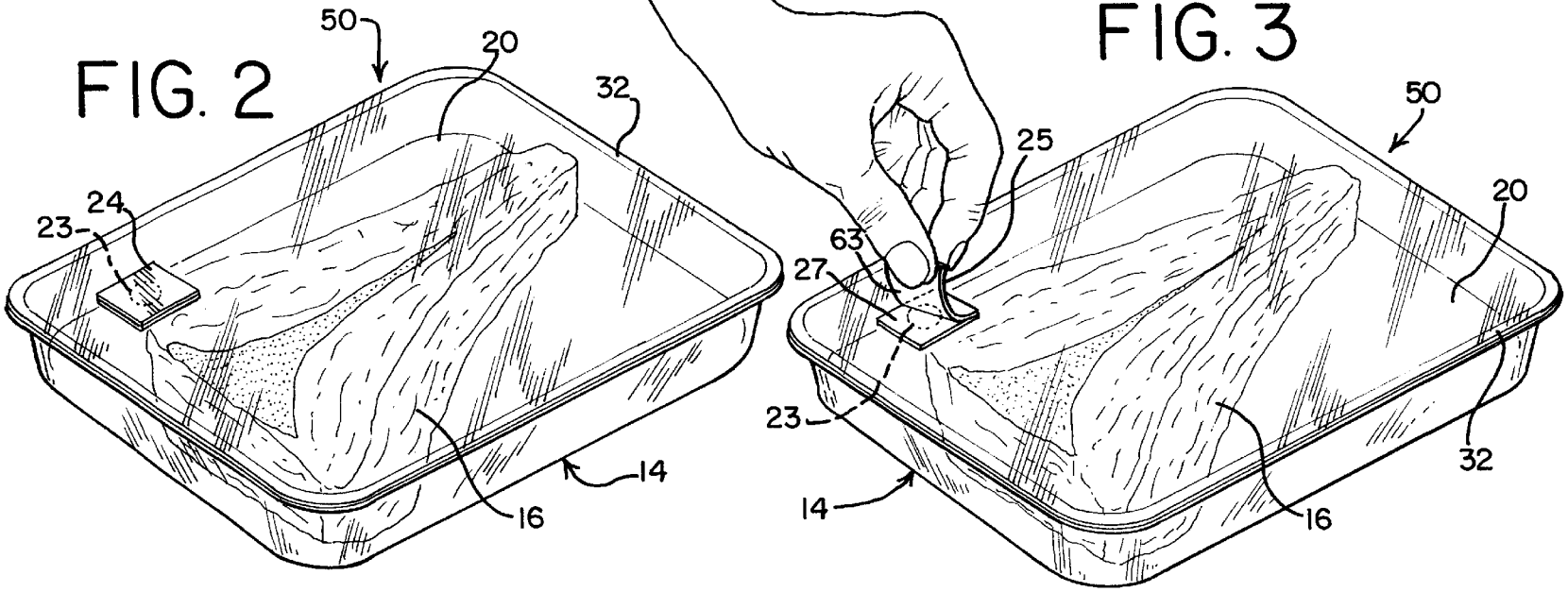
FIG. 3
FIG. 2

MEAT PACKAGING APPARATUS AND METHOD

FIELD OF THE INVENTION

The invention generally relates to the packaging of meat products in a controlled environment. More specifically the invention relates to an apparatus and method of packaging meat products in a first modified atmosphere environment for shipping to prolong shelf life and in a second atmospheric environment for display.

BACKGROUND OF THE INVENTION

Fresh meat products are typically processed to various cuts, at a meat processing facility, and then packaged in atmospheric conditions and shipped directly to the supermarket or retail market. Typically, the meat is packaged at the retail market in the Styrofoam trays which are overwrapped with a clear plastic film. Attempts have also been made to package the individual meat products at the processing facility in overwrapped Styrofoam trays, which are then placed within a vacuum-packed barrier bag. The shelf life of such packaging method is relatively short, which is primarily due to the prolonged exposure of the meat product to the residual oxygen present in the packaging. The prolonged exposure to oxygen also causes bacterial decay and discoloration of the meat product.

Particularly in red meat, the prolonged exposure to oxygen causes the conversion of myoglobin meat pigmentation to the grey or brown metmyoglobin, which is unacceptable to the customer. A controlled exposure to oxygen is necessary to oxygenate the meat pigment to a bright red color which, in general, retail customers associate with freshness.

To prevent discoloration and extend the shelf life of meat products, modified atmosphere packaging technologies are used. For example, U.S. Pat. Nos. 5,667,827 and 5,711,978 to Breen et al., disclose a package and method for packaging fresh meat in a substantially oxygen-free atmosphere, which includes a tray that is ventilated with holes and slits and sized to receive a piece of meat. A clear plastic wrapping material covers the tray. A number of these trays are then placed within an outer barrier bag which is evacuated and flushed with carbon dioxide and then sealed. The outer barrier bag is removed when the meat trays are ready for retail case-ready display.

One problem with this system is that it requires use of a perforated tray which may allow bacteria to enter the meat product while displayed. In addition, the packaging process requires the cumbersome grouping and packaging of a number of trays in an outer barrier bag, which then must be evacuated and flushed.

It would be desirable to have a package and process that would avoid the above problems and provide a package which would extend the storage life of meat products. In addition, it would be desirable to have an easy and efficient method for sealing a modified atmosphere tray. Moreover, it would be desirable to have a safe and efficient means of changing the atmosphere within the tray for retail display of the meat product.

SUMMARY OF THE INVENTION

One aspect of the invention provides a meat packaging apparatus comprising a tray containing a modified atmosphere and meat product, film sealed to the tray and including an opening formed therein, and a two-piece label attached to the film and covering the opening. The two-piece label includes a first layer removably attached to a second layer. An inner side of the second layer is secured to a portion of the film surrounding the opening. The second layer is made of a highly oxygen permeable material to allow oxygen to enter the tray when the first layer is removed. The first layer may be made of a material substantially impermeable to oxygen. Preferably, the tray includes a flange portion and the film is heat-sealed to the flange portion. The modified atmosphere may preferably comprise a blend of $CO_2$ and Nitrogen. Preferably, the inner side of the second layer is secured to the film with adhesive. Preferably, the first layer of the label may be made of a barrier-type plastic. Preferably, the second layer of the label may be made of a highly oxygen permeable material including, for example, paper. The second layer may further include a patterned barrier varnish to prevent wicking of oxygen. Preferably, the first layer of the label includes a raised portion to allow a user to grasp the raised portion and pull off the first layer.

Another aspect of the invention provides a method of preparing a meat product apparatus for retail presentation. A tray containing a modified atmosphere and meat product is provided. A film is sealed to the tray. The film includes an opening formed therein. A two-piece label is attached to the film and covers the opening. The two-piece label includes a first layer removably attached to a second layer. An inner side of the second layer is secured to a portion of the film surrounding the opening. The second layer is made of a highly oxygen permeable material. The first layer of the two-piece label is then removed. Oxygen flows through the highly oxygen permeable material of the second layer into the tray. This allows the meat product within the tray to achieve a bright red pigmentation. Prior to removing the first layer of the label the tray may be stored for an extended period of time, which may, for example, be about 14 days.

A further aspect of the invention provides for a method of packaging a tray with meat product. Trays containing meat product positioned on an intermittent conveyer are provided. A gassing rail positioned along the conveyer is also provided. A punch station and a label application station are positioned along a film infeed path and upstream of a sealing station. The trays are moved intermittently along the conveyer toward the sealing station. Controlled environment gas is flowed through the gassing rail and into the trays. An opening is punched in the film as it passes through the punch station. A two-piece label is then applied over the opening in the label application station. The portion of the film including the label covered opening is sealed to the tray to retain a modified atmosphere within the tray. Preferably, the film is dispensed in timed sequence with the intermittent conveyer.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

BRIEF DESCRIPTION OF THE DRAWINGS

FIG. 1 is a schematic diagram showing a preferred embodiment of a process for packaging fresh meat in accordance with the invention;

FIG. 2 is a perspective view of a preferred embodiment of a meat packaging apparatus made in accordance with the invention;

FIG. 3 is a perspective view of the embodiment of FIG. 2 showing a top layer of a two-piece label being peeled off to allow airflow into the package;

DETAILED DESCRIPTION OF THE PRESENTLY PREFERRED EMBODIMENTS

Figure 4:
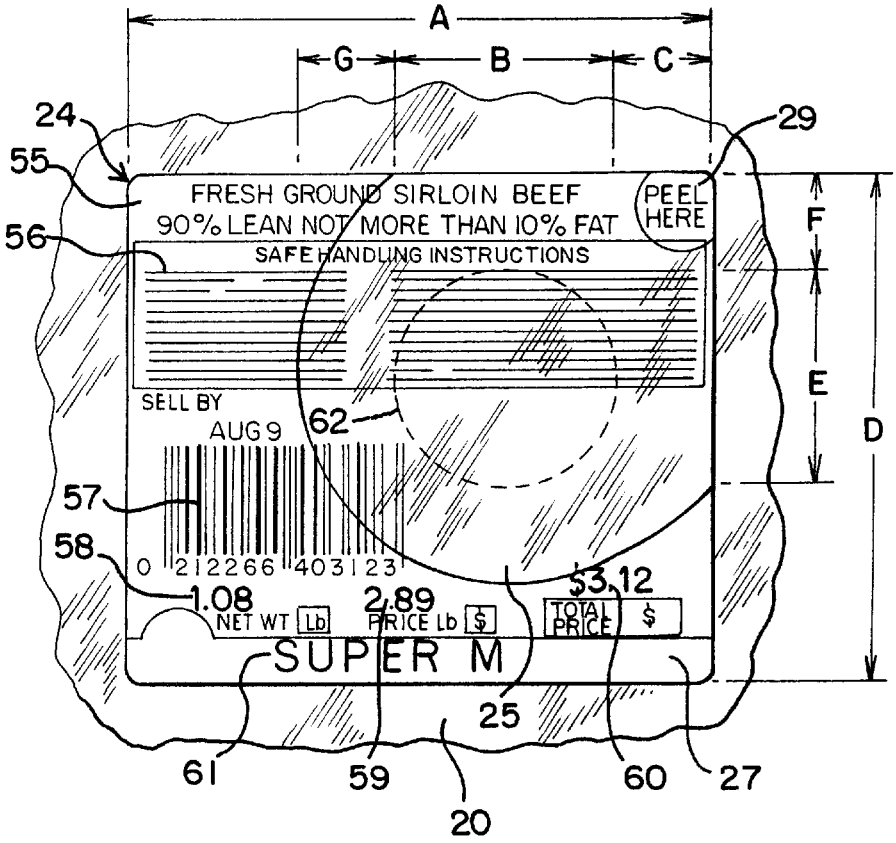
FIG. 4 is a top view of a preferred embodiment of a two-piece label made in accordance with the invention.

Referring to FIG. 1, a meat packaging system is generally shown as 10. The system generally includes a conveyer 12, which carries open top trays 14 filled with meat product 16 in the direction indicated by arrow 18. Plastic film 20 passes through punch station 22 where an opening 23 is cut through the film 20. A patterned adhesive-backed two-piece label 24 is then applied over the opening 23 at the label application station 26. The label 24 preferably includes a top layer 25 and bottom layer 27. The film 20 is then sealed to a flange portion 32 of the tray 14 in the sealing station 28.

As shown in FIG. 1, the open trays 14 and meat products 16 are preferably exposed to controlled environment gas or modified atmosphere gas using gassing rails 30. Preferred embodiments of the gassing rail 30 are disclosed in, for example, U.S. application Ser. Nos. 08/643,821 and 08/816,389, the entire disclosures of which are incorporated herein by reference. A preferred conveyer 12, which is preferably an intermittent conveyer, and sealing system are disclosed in, for example, U.S. application Ser. No. 08/886,963, the entire disclosure of which is incorporated herein by reference. Preferably, the meat product 16 is exposed to a controlled environment gas from the gassing rails 30 to reduce the residual oxygen to preferably less than 1 percent. For red meat, a preferred controlled environment gas may be a $CO_2$ and Nitrogen blend. Various $CO_2$ and Nitrogen blends may be used ranging from, for example, 40–60% $CO_2$ and 60–40% Nitrogen. In one preferred embodiment, for ground beef, a 50% $CO_2$ and 50% Nitrogen blend is used. Once sealed, the trays 14 may have an extended shelf life under refrigeration. Ground beef, for example, may be stored 14 days prior to retail display. Other lower pH products and/or salted products, including, for example, sausage may be stored, for about one month prior to removing the top layer 25. Generally, once the top layer 25 is removed the meat product has a display life of 3 days.

Although the punch station 22 and label station 26 are shown in a horizontal alignment in FIG. 1, these stations may be preferably vertically oriented and/or combined into a single station. In addition, the label application station 26 may further include a heat-sealer, which is designed to heat-seal the bottom layer 27 of the label 24 to the film 20. The heat-sealer may also be a stand alone station. If heat-sealed, the bottom side of the bottom layer 27 would not need adhesive. Preferably, the punch station 22 may be any conventional metal die punch. The punch 22 may be used to perforate or form a single opening in the film. If perforated, a greater film area and larger-sized label may be necessary to achieve adequate flow of oxygen into the tray once the top layer 25 of the label 24 is removed. The label application station 26 may include any conventional blown-on style label applicator, for example, as provided by Label-Aire of California. Alternatively, a tamping style label applicator with brush wipe may be used. As shown in FIG. 1, a nip roller 33 may preferably provide sufficient force to assure that the label 24 is securely attached to the film 20. The roller 33 also aids in removing any air bubbles trapped between the label 24 and film 20.

As shown in FIGS. 1 and 2, the tray 14 is preferably made from a material, which is substantially impermeable to or does not retain residual oxygen. The tray 14 may, for example, be made of thermo-formable plastic, including, but not limited to, polypropylene, polyvinyl chloride, polystyrene, polyester and any other barrier multi-layer laminations. The tray 14 includes a flange 32 which provides a sealing surface for film 20. The film 20 is preferably heat-sealed and cut in sealing station 20.

The two-piece adhesive-backed label 24 includes first or top layer 25, which is preferably substantially impermeable to oxygen, and a second or bottom layer 27, which is highly permeable to oxygen. Alternatively, the top and bottom layers may be substantially impermeable only in combination and in an unpeeled state. For example, the top and bottom layers may both be made of semi-permeable materials, but when used in combination provide a substantially impermeable label. Both layers preferably include pressure sensitive material, which may be stamped, marked, printed upon or otherwise inscribed with words or other symbols. The top layer 25 may include operating instructions, for example, "Remove for Retail Presentation" on its outer side. The bottom layer 27 may include a marking for the grade of meat, for example, "USDA Prime." The bottom layer 27 may additionally include the name of the retail store, a bar code, weight, price/lb., price and safe handling instructions. The top layer 25 preferably may include a raised portion and/or corner 29, which may include a portion or corner which does not contain adhesive to allow a user to easily grasp and peel the top layer 25 from the bottom layer 27. A light adhesive applied around the inner side of the top layer 25 and outer side of the bottom layer 27 may be sufficient to hold the top layer 25 in place during transportation and prolonged storage of the tray, and also allow the top layer 25 to be easily removed for store display. The top layer 25 may preferably be made of EVOH (ethyl vinyl alcohol) co-extrusion with a peelable adhesive coating on its bottom side. Alternatively, the top layer 25 may be made of other highly oxygen impermeable materials, including, Nylon, and other PVDC (poly vinyl dichloride) coated structures. The bottom layer 27 may preferably be made of a highly oxygen permeable material, which will allow sufficient oxygen into the tray to change the pigmentation of the meat to bright red, but prevent bacteria from contaminating the meat. Preferably, the bottom layer 27 may be highly permeable to oxygen and selectively impermeable to $CO_2$. The bottom layer 27 preferably includes an adhesive at least around the perimeter of the inner side of the bottom layer 27 to secure the label 24 to the film 20. The adhesive is preferably sufficiently strong to hold the bottom layer 27 in place during transportation and prolonged storage, and when the top layer 25 is peeled away.

The size of opening 23 may vary depending on, for example, the size of the tray and type and weight of the meat. For standard cut meats or ground beef contained in standard 6.75×8.75 inch trays, a 1⅛ inch diameter opening would be sufficient to allow a steady flow of oxygen into the tray. A 1.5×1.5 inch label would be sufficient to cover the opening and provide sufficient surface area to adhere to the surface of the film 20 surrounding the opening 23. Although a rectangular or square-shaped label 24 is shown, various shapes and sizes of labels may alternatively be used.

Figure 5:
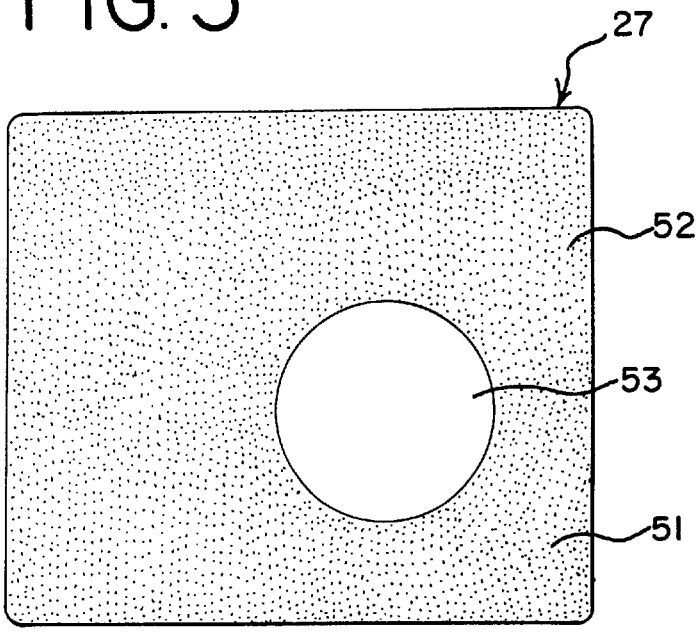
FIG. 5 is a bottom view of the embodiment of FIG. 4.

Referring to FIGS. 4 and 5, a preferred embodiment of the label 24 is shown for use with a 6.75×8.75 inch tray filled, for example, with ground beef. As shown in FIG. 5, the bottom side 51 of the bottom layer 27 includes a patterned hot melt adhesive 52, for example, having a thickness of 1 mil. The adhesive 52 covers all of bottom side 51 except for the area 53, which aligns with opening 23. The label 24 in the embodiment shown in FIGS. 4 and 5, may have, for example, the following dimensions: A=3 inches, B=1⅛ inches, C=½ inch, D=2⅝ inches, E=1⅛ inches, F=½ inch, and G=½ inch. As shown in FIG. 4, the top side of the bottom layer 27 may preferably include various printed fields including type and/or grade of meat 55, safe handling instructions 56, bar code 57, net weight 58, price/lb. 59, total price 60 and retail name 61. These fields may be printed on the bottom layer 27 prior to application on the film 20, which will reduce the retail operator's handling costs in preparing the tray for case display. In the embodiment of FIGS. 4 and 5, the bottom layer 27 preferably has an absolute filtration rating of 0.2 microns, which will restrict bacteria from penetrating into the sealed tray. The top layer 25 may preferably be a die-cut barrier label film, which includes a patterned adhesive 63 on its backside, except for the circular area 62 (shown in phantom) which aligns with opening 23. Approximately, 1 mil of adhesive 63 may be used. The bottom layer 27 may, for example, be paper with a 0.2 micron weave which may include a patterned barrier varnish applied to an upper surface except in area 53. The patterned barrier varnish aids in increasing the impermeability of the label and in preventing wicking of oxygen into the tray. The bottom layer 27 may further preferably include a patterned ink receptive varnish to receive various print colors applied by, for example, an ink jet printer. On the backside of the bottom layer 27, the patterned adhesive 52 of, for example, 1 micron secures the label 24 to the lid stock barrier film 20. The bottom side 51 of the bottom layer 27 may be covered with a silicone-coated paper liner. This liner is removed prior to application of the label 24 on the film 20. This label design allows the area of the bottom layer 27, which communicates with opening 23, to be free of any varnish or adhesive to allow oxygen to quickly enter the tray once the top layer 25 of the label 24 is removed.

Tests were run using the following: a 6¾×8¾ multi-layer barrier tray, one pound of ground beef, a 50/50 $CO_2$ and Nitrogen blend of controlled environment gas, and barrier lid stock heat-sealed to the tray. The label 24, shown in FIGS. 4 and 5 was used. In this test, the sealed tray initially contained 0.25% oxygen. Over a period of 14 days, the oxygen within the tray slowly increased to a level of 0.5%. Once the top layer 25 was removed on day 15, the oxygen content rose in a short time period of about 15 minutes to 18.5% and reached 20.9% within a few hours. This rapid inflow of oxygen is beneficial to retail store operators to allow the meat to properly bloom within about an hour of removing the top layer 25. Selective permeability of the label 24 to $CO_2$ may aid in maintaining a partial bacterial static $CO_2$ atmosphere within the tray.

In operation, the freshly cut meat product 16 may be placed into trays 14 moving along conveyer 12. Soaker pads may also be placed in the trays 14 prior to placing in the meat 16. The soaker pads absorb excess juices from the meat which may occur during periods of prolonged storage. The trays 14 and meat product 16 are then exposed to controlled environment gas from gassing rails 30 as the trays 14 are indexed forward to the sealing station 28. A combination of vacuum and controlled environment gassing may alternatively be used. While the trays 14 are indexed toward the sealing station 28, the film 20 is dispensed to allow opening 23 to be cut out at the punch station 22 and label 24 to be applied at the label application station 26. For example, the punch station 22 may be positioned two tray pitches from the sealing station 28, and the label application station 26 may be positioned one container pitch from the sealing station 28. Alternatively, the punch station 22 and label application station 26 may be combined into one station, where the opening 23 is punched and the label 24 is applied simultaneously or immediately after the opening 23 is punched. For this alternative embodiment, the punch/label station may be positioned, for example, one pitch away from the sealing station.

At the sealing station 28 the portion of the film 20 which includes the label covered opening 23 is positioned over the tray 14 to allow communication of the opening 23 with the atmosphere within the tray 14. Preferably, the film 20 is dispensed with dispensing system rollers 40, which may be programmed along with the intermittent conveyer 12 in timed sequence with a programmable logic controller. The film 20 is then preferably heat-sealed to the flange 32, and cut outside and along the perimeter of the flange 32. This set-up provides an efficient packaging operation, while allowing flexibility to quickly adjust the punch station 22 to provide openings or cuts of various sizes and configurations. This system also allows a user to quickly replace the labels 24 to match the size and/or configuration of the openings 23. Moreover, labels with standardized markings including, for example, meat grades, may be quickly inserted to match each different grade of meat being packaged.

Referring to FIGS. 2 and 3, the sealed tray or meat packaging apparatus 50 may then be shipped to its retail destination where the first or top layer 25 may be removed from the bottom layer 27. Oxygen then flows through the semi-permeable membrane of the second or bottom layer 27 to allow the meat to bloom to an appealing red color. The size of the opening 23 and the high oxygen permeability of the bottom layer 27 allow a sufficient amount of oxygen to enter the tray to achieve the desired red color, without overexposing the meat product 16 to the outside environment and its many contaminants including bacteria.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. Meat packing apparatus comprising:

a tray containing a modified atmosphere and meat product;

an oxygen impermeable film sealed to the tray, the film including an opening formed therein; and a two piece label attached to the film and covering the opening, the two-piece label including a first oxygen impermeable layer removably attached to a second layer, an inner side of the second layer secured to a portion of the film surrounding the opening, the second layer comprising a highly oxygen permeable paper material to allow oxygen to enter the tray and restrict bacteria from entering the tray when the first layer is removed.

2. The apparatus of claim 1 wherein the tray includes a flange portion, the film heat-sealed to the flange portion.

3. The apparatus of claim 1 wherein the modified atmosphere comprises $CO_2$.

4. The apparatus of claim 1 wherein the inner side of the second layer is secured to the film with adhesive.

5. The apparatus of claim 1 wherein in the meat product comprises red meat.

6. The apparatus of claim 1 wherein the opening has a width of about 1 inch, and the tray has a width of 6 inches and a length of 8 inches.

7. The apparatus of claim 1 wherein the first layer comprises a barrier-type plastic.

8. The apparatus of claim 1 wherein the second layer comprises paper.

9. The apparatus of claim 8 wherein the second layer further comprises a pattern barrier varnish to prevent wicking of oxygen.

10. The apparatus of claim 1 wherein the tray is made of a multi-layer thermoformed plastic.

11. The apparatus of claim 1 wherein the first layer includes a raised portion to allow a user to grasp the portion and pull off the first layer.

12. The apparatus of claim 1 wherein the label has a corner portion to allow a user to pull the corner portion to remove the first layer.

13. The apparatus of claim 1 wherein the label has a rectangular shape.

14. The apparatus of claim 1 wherein the bottom layer of the label includes adhesive to secure the label to a portion of the film surrounding the opening.

15. A method of preparing a meat packing apparatus for retail presentation comprising:

providing a tray containing a modified atmosphere and meat product, an oxygen impermeable film sealed to the tray, the film including an opening formed therein, and a two piece label attached to the film and covering the opening, the two-piece label including a first oxygen impermeable layer removably attached to a second layer, an inner side of the second layer secured to a portion of the film surrounding the opening, the second layer comprising highly oxygen permeable paper material;

removing the first layer of the two-piece label; and flowing oxygen through the highly oxygen permeable material of the second layer; and restricting bacteria from entering through the opening.

16. The method of claim 15 wherein the meat product comprises red meat and the modified atmosphere comprises a $CO_2$ and Nitrogen blend of gas, flowing oxygen through the highly oxygen permeable material to change the pigmentation of the red meat to a brighter red color.

17. The method of claim 15 further comprising:

storing the tray for an extended period of time prior to removing the first layer.

18. The method of claim 17 wherein the extended period of time comprises at least one month.

* * * * *